US011975810B2

(12) United States Patent
Song et al.

(10) Patent No.: US 11,975,810 B2
(45) Date of Patent: May 7, 2024

(54) BIONIC FISH SINGLE-DEGREE-OF-FREEDOM MODULAR STRUCTURE BASED ON CAM MECHANISM

(71) Applicant: Tianjin University, Tianjin (CN)

(72) Inventors: Zhibin Song, Tianjin (CN); Zhongru Fu, Tianjin (CN)

(73) Assignee: Tianjin University, Tianjin (CN)

( * ) Notice: Subject to any disclaimer, the term of this patent is extended or adjusted under 35 U.S.C. 154(b) by 433 days.

(21) Appl. No.: 17/455,877

(22) Filed: Nov. 19, 2021

(65) Prior Publication Data

US 2022/0266966 A1 Aug. 25, 2022

(30) Foreign Application Priority Data

Feb. 20, 2021 (CN) ..... 202110194105.5

(51) Int. Cl.

| | |
|---|---|
| ***B63G 8/00*** | (2006.01) |
| ***B63H 1/36*** | (2006.01) |
| ***B63H 21/17*** | (2006.01) |

(52) U.S. Cl.

CPC ..... *B63G 8/001* (2013.01); *B63H 1/36* (2013.01); *B63H 21/17* (2013.01); *B63G 2008/002* (2013.01)

(58) Field of Classification Search

CPC .... B63G 8/00; B63G 8/001; B63G 2008/002; B63H 1/36; B63H 21/17

See application file for complete search history.

(56) References Cited

FOREIGN PATENT DOCUMENTS

| | | | | |
|---|---|---|---|---|
| CN | 104118549 A | * | 10/2014 | |
| CN | 107310705 A | * | 11/2017 | ..... B63G 8/22 |

* cited by examiner

*Primary Examiner* — Stephen P Avila

(74) *Attorney, Agent, or Firm* — Eversheds Sutherland (US) LLP

(57) ABSTRACT

Disclosed is a bionic fish single-degree-of-freedom modular structure based on a cam mechanism. The bionic fish single-degree-of-freedom modular structure comprises a plurality of modules which are sequentially connected, wherein the foremost one of the modules is a fish head module, and the last one of the modules is a fish tail module; each module in the modules comprises a rack, a rotating shaft is arranged in the center of the rack in a penetrating mode, the second end of the rotating shaft of the previous module is connected to the first end of the rotating shaft of the next module through a universal coupling, the next module is connected with the previous module through a swing connecting piece, and the effect that the modules swing in a plane is achieved.

7 Claims, 5 Drawing Sheets

BIONIC FISH SINGLE-DEGREE-OF-FREEDOM MODULAR STRUCTURE BASED ON CAM MECHANISM

CROSS REFERENCE TO RELATED APPLICATION

This application claims priority to Chinese Application No. 202110194105.5, filed Feb. 20, 2021. The content of this application is incorporated herein by reference.

TECHNICAL FIELD

The present disclosure relates to a robot, in particular to a bionic fish single-degree-of-freedom modular structure based on a cam mechanism.

BACKGROUND ART

Currently, there is an increasing demand for unmanned underwater detection, such as exploration of dynamic underwater environments, pollution source tracking, underwater archaeology, search and rescue, and so forth. Conventional designs for most autonomous underwater vehicles have propellers as the primary means of propulsion, but propeller-based motion has the problems such as low maneuverability, low efficiency and high power consumption. In addition, the rotation of a propeller may produce more marine debris, so that the mortality of marine organisms is increased, and disturbances are caused to the shallow water ecosystem. The bionic underwater vehicle can be quieter, higher in maneuverability (the probability of accidents is reduced) and lower in power consumption (the task execution time is longer). Meanwhile, the bionic underwater vehicle can keep the original state of the surrounding environment and is used for data acquisition and detection. The motion posture of fish can be realized through a mechanical structure and motion control, and the design method can be divided into two types, namely discrete body design and continuum design. The former type is of a multi-drive multi joint structure, and although the effect of simulating the motion of multiple sections of fish bodies can be easily achieved by configuring multiple motors, it is difficult to coordinate each swing joint to achieve efficient swimming. The idea of the continuum design is single-drive multi-joint, the structure is driven by only one motor, the motion effect is achieved through a mechanical structure, and the device is simple in structure, safe, reliable and low in cost. Therefore, it is necessary to design a novel single-degree-of-freedom mechanical structure to achieve the motion effect of fish.

SUMMARY

The present disclosure aims to overcome the defects in the prior art, and provides a bionic robotic fish single-degree-of-freedom modular structure based on a cam mechanism for an autonomous underwater vehicle. The device simulates the shape of sailfish, is driven by a single motor, transmits motion through a mechanical structure, and realizes the swimming postures of the sailfish. Modular design is used, and different moving postures can be achieved by replacing different modules.

Through the technical scheme adopted by the present disclosure, a bionic fish single-degree-of-freedom modular structure based on a cam mechanism comprises a plurality of modules which are sequentially connected, the foremost one of the modules being a fish head module, and the last one of the modules being a fish tail module; each module in the modules comprising a rack, a rotating shaft being arranged in the center of the rack in a penetrating mode so that the first end of the rotating shaft is located on the first side of the rack and the second end, opposite to the first end, of the rotating shaft is located on the second side, opposite to the first side, of the rack, and the second end of the rotating shaft of the previous module being connected to the first end of the rotating shaft of the next module through a universal coupling, wherein the fish head module is internally provided with a control motor, and the control motor is used for driving a rotating shaft of the fish head module to rotate;

and the bionic fish single-degree-of-freedom modular structure further comprises swing connecting pieces arranged between the adjacent modules of the modules, the swing connecting piece comprising:

cylindrical cams, the cylindrical cams being arranged on the second side of the rack of the previous module, being arranged on the rotating shaft of the module and being capable of rotating along with the rotation of the rotating shaft;

pin shafts, the pin shafts being fixed on the second side of the rack of the previous module;

first bearings, the front bearing being arranged on the first side of the rack of the next module, the first side of the rack of the next module being connected with the pin shafts on the second side of the rack of the previous module through the first bearings, and the first bearings being used for enabling the rack of the next module to swing around the axes of the hinge pins of the rack of the previous module; and second bearings, the second bearings being arranged on the first side of the rack of the next module, inner rings of the second bearings being fixed on bearing supports and being connected to the rack of the next module through the bearing supports, outer rings of the second bearings being in contact with the cylindrical cam of the previous module, so that the cylindrical cam of the previous module rotate to push the second bearings of the next module to reciprocate, and then the rack of the next module swings around the axes of the pin shafts of the rack of the previous module.

Further, the cylindrical cam is of a cylindrical structure, the side walls of the cylindrical structures are unequal in heights, the contact points of the cylindrical cams and the second bearings are used as initial positions of the cylindrical cams when the structure simulates a fish body fluctuation curve at the moment t, and when the contour of the inner radius of the cylindrical structure is unfolded into a plane along the high position where the initial positions are located, and the outline of the end part, in contact with the second bearings, of the cylindrical structure is a curve.

Further, the curve is obtained by calculating the contour height of the cylindrical cam at each moment in one period through an actual sailfish fluctuation curve and approximating through a sine curve.

Further, in the modules, the modules except the fish head module and the fish tail module are fish body modules, and the number of the fish body modules is larger than or equal to 0.

Further, the fish head module is further internally provided with a battery pack for providing energy.

Further, the fish head module is further internally provided with a control panel, the control panel is connected with the control motor, and the control panel receives signals of an upper computer and controls the activity and the rotating speed of the control motor.

Further, the number of the pin shafts is two, the two pin shafts are arranged along the circumferential direction of the rack where the pin shafts are located at an interval of 180°, and the first bearings correspond to the pin shafts in a one-to-one mode; and the number of the second bearings is two, the two second bearings are arranged along the circumferential directions of the cylindrical cams matched with the second bearings at an interval of 180°, and the planes where the two bearing supports for fixing the two second bearings are located are perpendicular to the axes of the pin shafts.

The present disclosure has the beneficial effects that a single-degree-of-freedom modular bionic robot fish is designed according to the swimming postures of the sailfish. The device can be driven by a single motor and transmit motion through a mechanical structure to achieve the fluctuation postures of fish bodies. Modular design is used, and different swimming postures can be achieved by replacing different modules.

REFERENCE SIGNS

Figure 1:
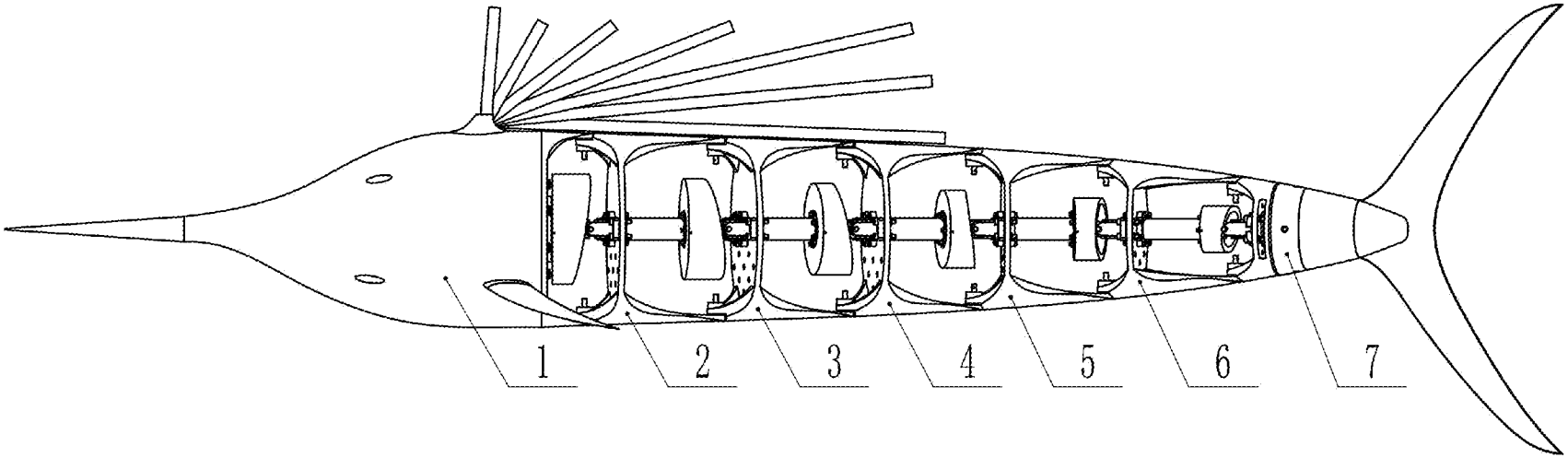
FIG. 1 is a schematic diagram of a complete machine of a bionic fish single-degree-of-freedom modular structure in the present disclosure.

1, fish head module;
2, first fish body module;
3, second fish body module;
4, third fish body module;
5, fourth fish body module;
6, fifth fish body module;
7, fish tail module;
8, fish head shell;
9, control panel;
10, battery pack;
11, battery support;
12, control motor;
13, rack;
14, rotating shaft;
15, universal coupling;
16, cylindrical cam;
17, pin shaft;
18, fin ray;
19, first bearing;
20, second bearing;
21, bearing support;
22, tail stem; and
23, tail fin.

DETAILED DESCRIPTION OF THE EMBODIMENTS

For the purpose that the summary, characteristics and efficacy of the present disclosure can be further understood, the following embodiments are exemplified and will be described in detail with reference to the attached figures as follows:

As shown in FIG. 1 to FIG. 6, a bionic fish single-degree-of-freedom modular structure based on a cam mechanism only has one degree of freedom and is driven by a single motor, and the swimming postures of fish are achieved through the mechanism design. Due to the modular design, different swimming postures can be realized by replacing the modules. The bionic fish single-degree-of-freedom modular structure comprises a plurality of modules which are sequentially connected, the foremost one of the modules is a fish head module 1, the last one of the modules is a fish tail module 7, the other modules are fish body modules, and the number of the fish body modules is random and is larger than or equal to 0. in the embodiment, the number of the fish body modules is five, and are respectively a first fish body module 2, a second fish body module 3, a third fish body module 4, a fourth fish body module 5 and a fifth fish body module 6. The fish head module 1 is a rack module of the robotic fish and comprises a power and control part of the robotic fish; the fish body module is a transmission and working part of the robotic fish, and different swimming postures can be realized by replacing module structures in the fish body module; and the fish tail module 7 is the working part of the machine.

Each module in the modules comprises a rack 13, a rotating shaft 14 is arranged in the center of the rack 13 in a penetrating mode so that the first end of the rotating shaft 14 is located on the first side of the rack 13 and the second end, opposite to the first end, of the rotating shaft 14 is located on the second side, opposite to the first side, of the rack 13, the second end of the rotating shaft 14 of the previous module is connected to the first end of the rotating shaft 14 of the next module through a universal coupling 15, and torque is transmitted through the universal couplings 15 between the modules. The universal coupling is matched with the rotating shaft 14 through a hexagonal hole and fixed through a jackscrew, and power is transmitted to the next module.

Figure 2:
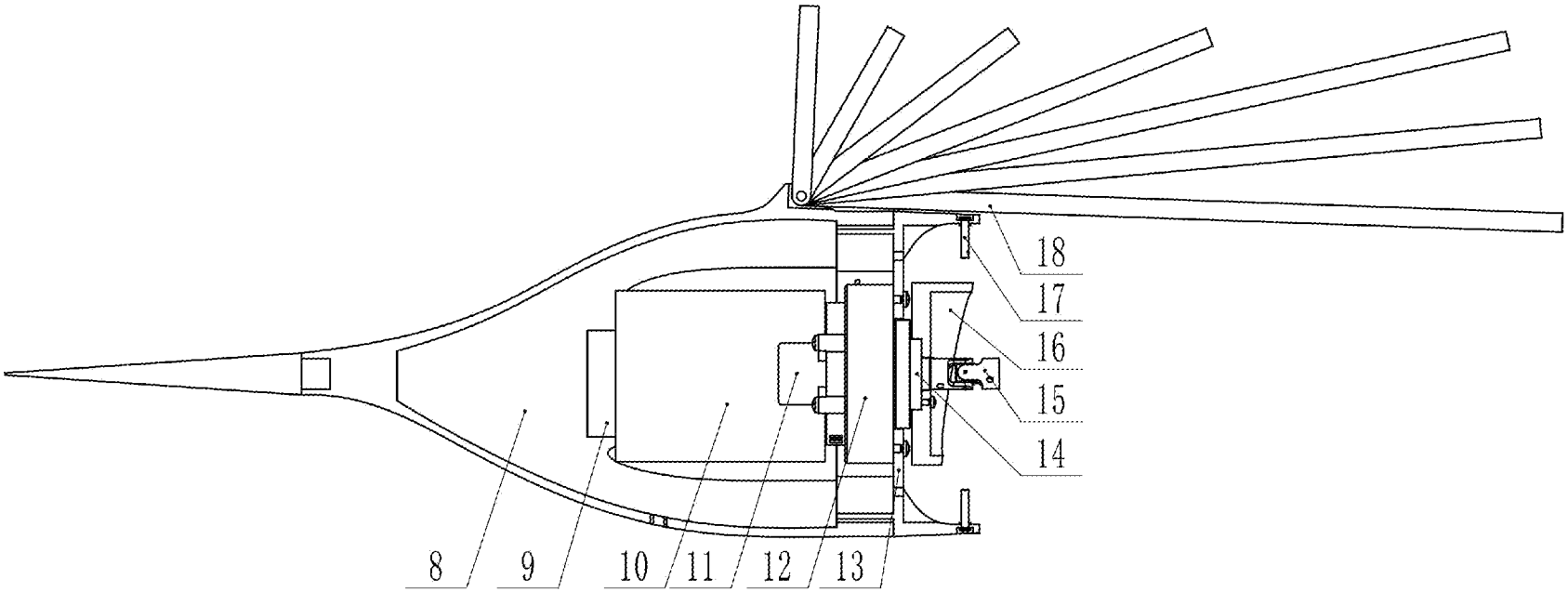
FIG. 2 is a structural schematic diagram of a fish head module in the present disclosure.

The structure of the fish head module 1 is shown in FIG. 2, the fish head module 1 is internally provided with a control motor 12, a battery pack 10 and a control panel 9, and the control motor 12, the battery pack 10 and the control panel 9 are all located on the first side of the rack 13 of the fish head module. The control motor 12 is fixed on the rack 13 of the fish head module 1 through screws, the rotating shaft 14 of the fish head module 1 is fixed on the control motor 12 through screws, the control motor 12 drives the rotating shaft 14 of the fish head module 1 to rotate, and the rotating shaft 14 of the fish head module 1 can be an output shaft of the control motor 12. In the embodiment, the control motor 12 is a disc type motor. The battery pack 10 is fixed through a battery support 11, the battery support 11 is fixed to the control motor 12 through screws, the battery pack 10 provides energy for the control motor 12, and in the embodiment, the battery pack 10 is a lithium battery pack. The control panel 9 is connected with the control motor 12, receives signals of an upper computer and controls the activity and the rotating speed of the control motor 12. A plurality of copper plate fin rays 18 are arranged on the fish back portion of the fish head module 1, and the fin rays 18 are coated with a flexible material to simulate the dorsal fins of sailfish. The first side of the rack 13 of the fish head module is connected with a fish head shell 8, and the fish head shell 8 is used for packaging the structure in the fish head module 1.

Figure 3:
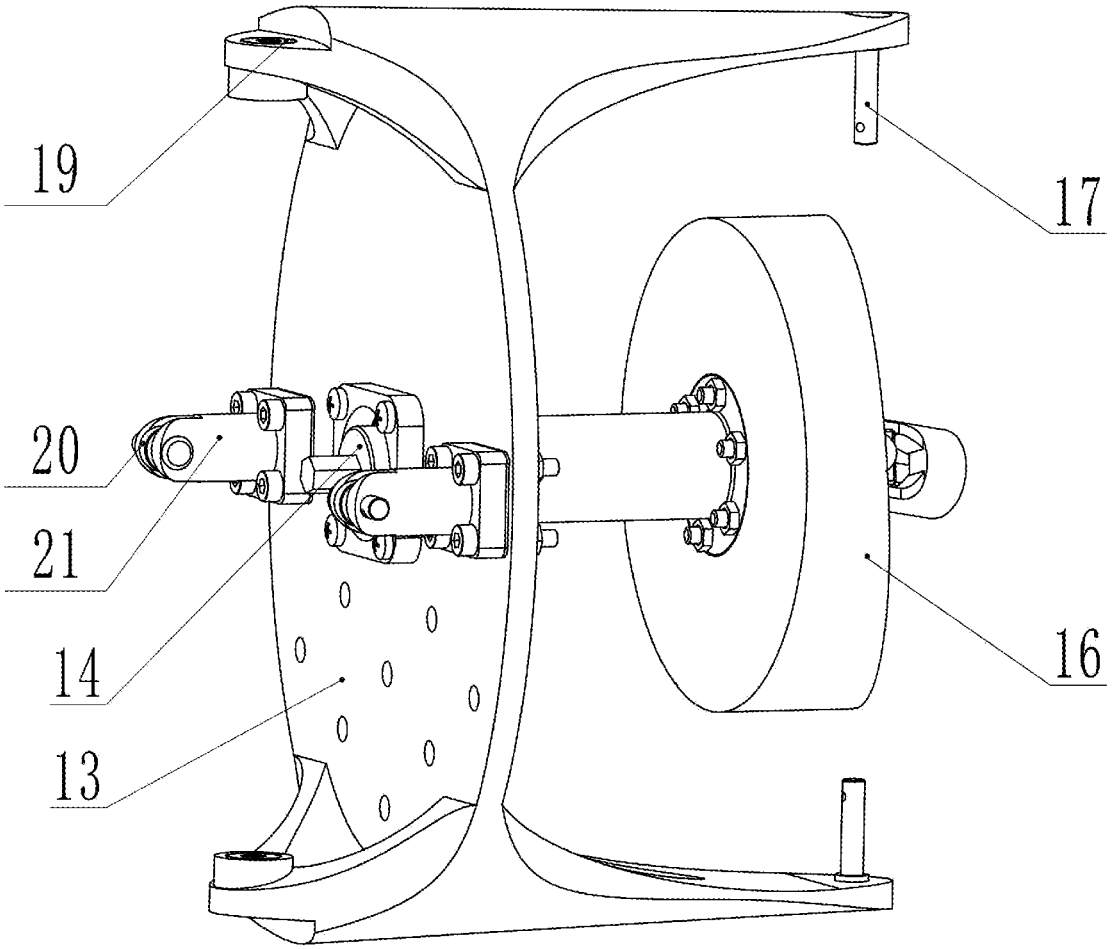
FIG. 3 is a structural schematic diagram of fish body modules in the present disclosure.
Figure 4:
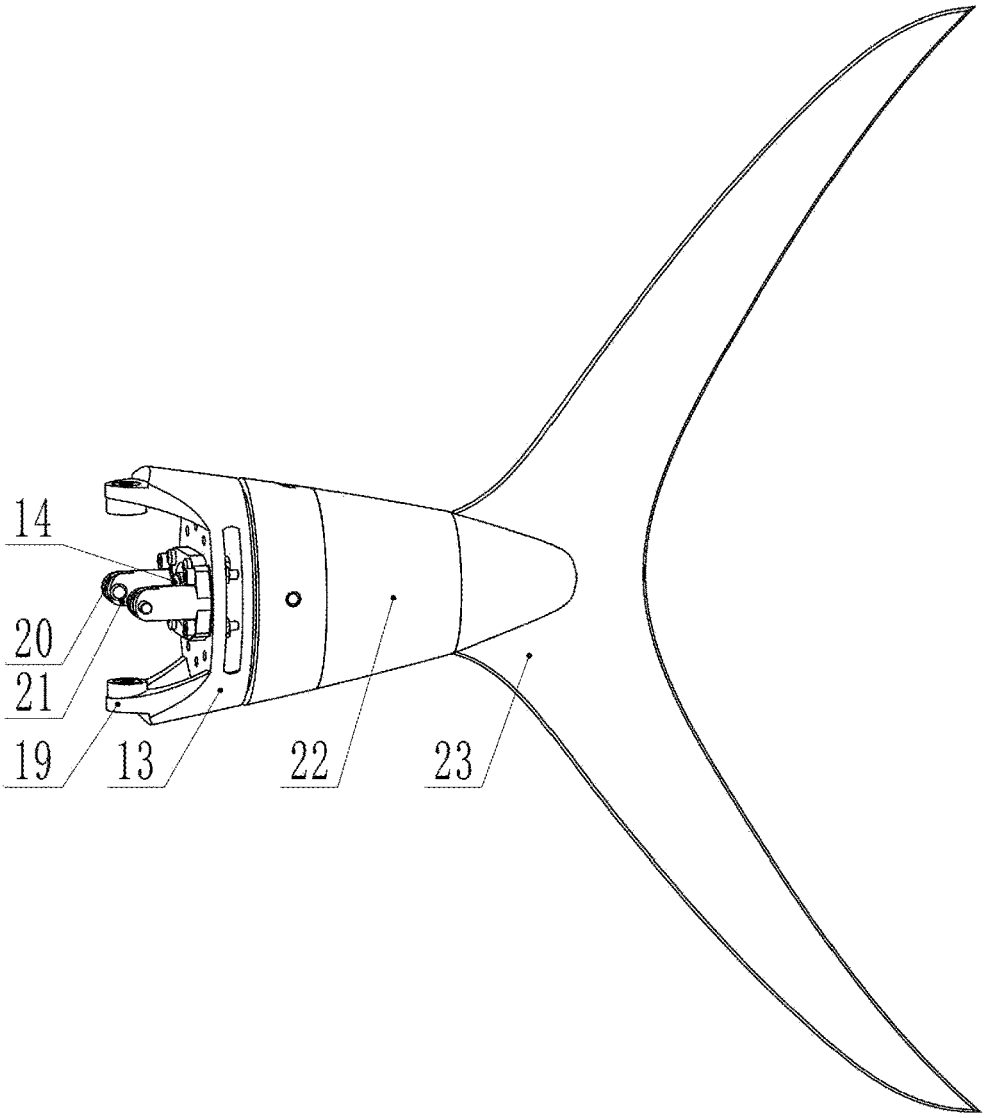
FIG. 4 is a structural schematic diagram of a fish tail module in the present disclosure.

The structure of the fish body module is shown in FIG. 3, the structure of the fish tail module 7 is shown in FIG. 4, the rotating shafts 14 of the fish body module and the fish tail module 7 are matched with the racks 13 where the rotating shafts 14 are located through bearings, and the bearings are fixed through bearing end covers. The fish tail module 7 is connected to the end of the whole machine structure to form a complete sailfish posture, the second side of the rack 13 of the fish tail module 7 is sequentially connected with a flexible tail stem 22 and a half-moon-shaped tail fin 23, the tail fin 23 is made of flexible materials, under the action of water resistance, the tail fin 23 swings in a self-adaptive mode, and the swimming posture of the sailfish is conformed preferably.

The bionic fish single-degree-of-freedom modular structure further comprises swing connecting pieces arranged between the adjacent modules of the modules, and the swing connecting piece comprises cylindrical cams 16, pin shafts 17, first bearings 19 and second bearings 20. The cylindrical cams 16 are arranged on the second side of the rack 13 of the previous module, are connected to the rotating shaft 14 of the module through screws and can rotate along with the rotation of the rotating shaft 14, and the cylindrical cam 16 is matched with the second bearing 20 of the next module, so that an included angle matched with a fish body fluctuation curve is formed between the previous module and the next module. The pin shafts 17 are fixed on the second side of the rack 13 of the previous module. The number of the pin shafts 17 is two, and the two pin shafts 17 are arranged along the circumferential direction of the rack 13 where the pin shafts 17 are located at an interval of 180°. The first bearings 19 are arranged on the first side of the rack 13 of the next module, correspond to the pin shafts 17 of the previous module in a one-to-one mode, and are used for being coaxially matched with the pin shafts 17. The first side of the rack 13 of the next module is connected with the pin shafts 17 on the second side of the rack 13 of the previous module through the first bearings 19 and used for restraining the next module, so that the rack 13 of the next module can swing around the axes of the pin shafts 17 of the rack 13 of the previous module, and the rack 13 of the next module is prevented from rotating along the axis of the rotating shaft 14 of the rack 13. The second bearings 20 are arranged on the first side of the rack 13 of the next module, the number of the second bearings 20 is two, the two second bearings 20 are arranged at an interval of 180° along the circumferential directions of the cylindrical cams 16 matched with the second bearings 20, and the planes where the two bearing supports 21 for fixing the two second bearings 20 are located are perpendicular to the axes of the pin shafts 17. The second bearings 20 can rotate around the axes of the second bearings 20 and cannot move along the axes of the second bearings 20, the inner ring of each second bearing 20 is fixed to a bearing support 21 through the pin shaft, the bearing support 21 is fixed to the rack 13 of the next module through screws, the outer ring of each second bearing 20 is in contact with the cylindrical cam 16 of the previous module, and the outer ring of each second bearing 20 is in contact with the cylindrical cam 16 of the previous module, so that the cylindrical cam 16 of the previous module rotates to push the second bearing 20 of the next module to reciprocate and then achieve the swing of the rack 13 of the next module around the axis of the pin shaft 17 of the rack 13 of the previous module. The cylindrical cams 16 are matched with the second bearings 20 to fit included angles between line segments of the fish body fluctuation curve, and the pin shafts 17 are matched with the first bearings 19 to apply constraint to swing of the modules, so that the modules are prevented from rotating around the axial direction during movement.

When the control motor 12 in the fish head module 1 outputs torque to drive the rotating shaft 14 and the cylindrical cam 16 of the fish head module 1 to rotate, the rotating shaft 14 of the next module is connected with the adjacent module through the universal coupling 15 and the rotating shaft 14 of the previous module. The rotation of the rotating shaft 14 of the previous module is transmitted to the rotating shaft 14 of the next module and the cylindrical cam 16 of the next module is driven to rotate. Meanwhile, the second bearings 20 on two bearing supports 21 of the next module are in line contact with the cylindrical cam 16 of the previous module (or a cylindrical universal ball is in point contact with the cylindrical cam 16). The cylindrical cam 16 pushes the second bearing 20 to drive the rack 13 of the next module to swing, so that all the fish body modules and the fish tail module 7 swing in a plane; and in addition, the pin shaft 17 of the previous module is matched with the first bearing 19 of the next module to limit the rack 13 of the next module to rotate around the rotating shaft 14 of the rack 13, and all the fish body modules and the fish tail module 7 are restrained.

Figure 5:
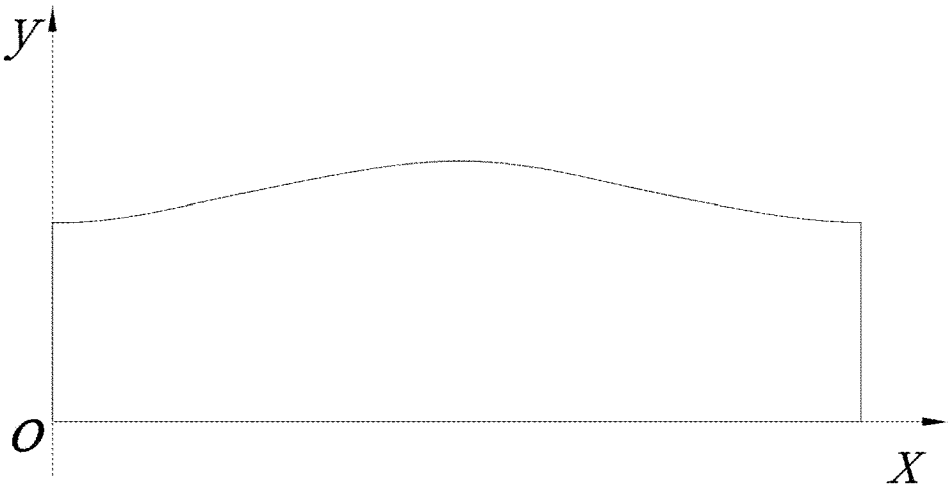
FIG. 5 is a schematic diagram of the contour shape of a cylindrical cam in the present disclosure.

Wherein, the angle of module swing is performed according to the designed cylindrical cams 16, and different swimming postures are achieved by the cylindrical cams 16 with different profiles. Specifically, the cylindrical cam 16 is of a cylindrical structure, the side walls of the cylindrical structures are unequal in heights, as shown in FIG. 5, the contact points of the cylindrical cams 16 and the second bearings 20 are used as initial positions of the cylindrical cams 16 when the structure simulates a fish body fluctuation curve at the moment t. When the cylindrical structure is unfolded into a plane along the high position of the initial positions at the inner radius, the contour shape of the end portion of the cylindrical structure in contact with the second bearing 20 is a curve, the curve determines the swing angle of the module. Moreover, different cam profiles can be designed to achieve different swimming postures by designing different curves. In the embodiment, the curve is obtained by calculating the contour height of the cylindrical cam 16 at each moment in one period through an actual sailfish fluctuation curve and approximating through a sine curve. In addition, modular design is adopted, and cylindrical cams 16 with different contour shapes are adopted for the modules, so that different swimming postures can be realized by directly replacing the modules.

Through the structure, the swimming postures of fish can be simulated.

Figure 6:
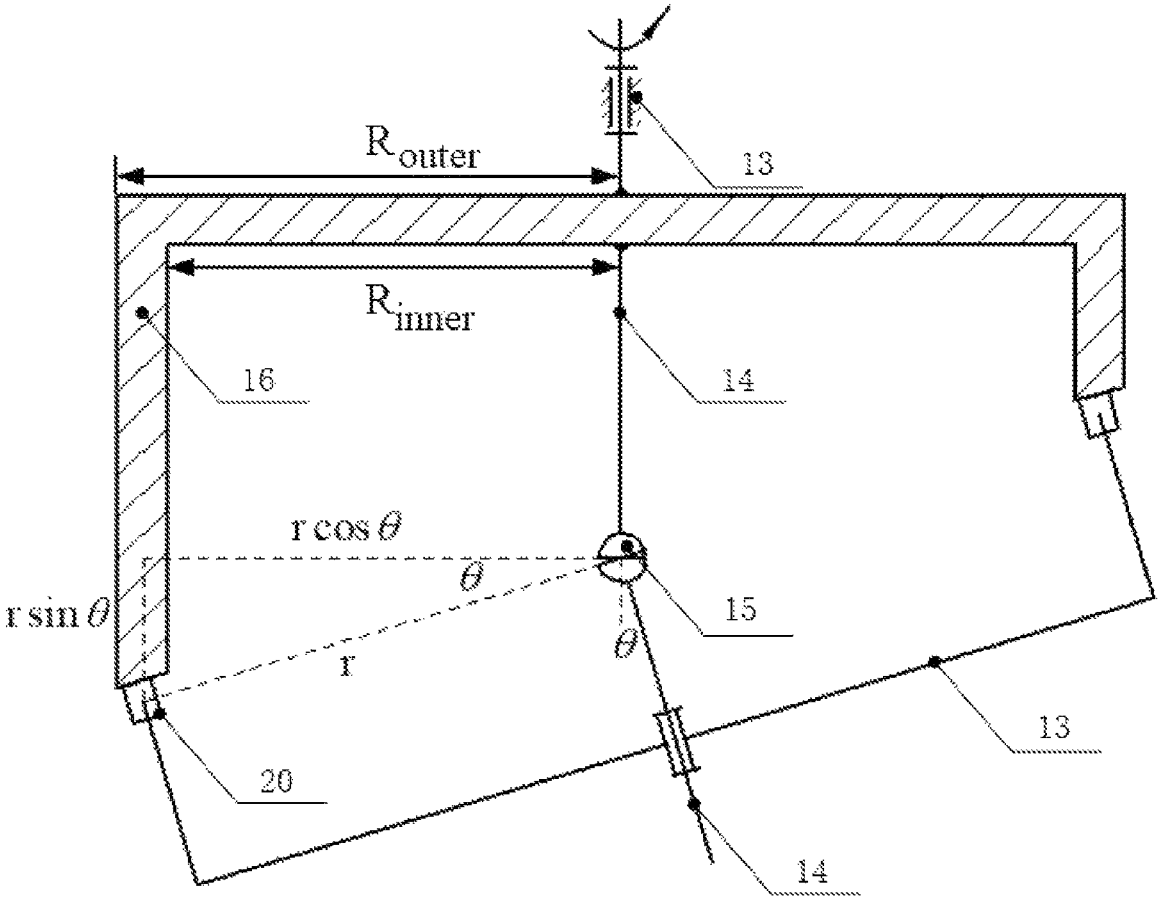
FIG. 6 is a schematic diagram of a simulated fluctuation posture in the present disclosure.

According to the structure, a Lighthill equation is used for describing the fluctuation curve of the fish body, line segments are used for fitting of the curve (six line segments are used for fitting in the embodiment, and therefore five fish body modules and one fish tail module 7 are adopted), and then the included angle theta between the line segments in the fish body fluctuation process can be obtained as shown in FIG. 6. The principle of the structure for simulating the fluctuation attitude is shown in FIG. 6. The distance between the second bearing 20 and the swing center of the rack 13 (namely the swing center of the next module) is r, and the radius r cos theta and the wall height r sin theta of the theoretical contour of the cylindrical cam 16 making contact with the second bearing 20 at the moment can be obtained through the included angle theta between line segments (namely the included angle between the previous module and the next module). The working profile of the cylindrical cam 16 can be obtained from the theoretical profile. To ensure that the cylindrical cam 16 maintains line contact with the second bearing 20 during rotation, the profile surface of the cylindrical cam 16 is a ramp as shown in FIG. 6. The wall thickness range of the cylindrical cam 16 can be obtained through the radius r cos theta of the theoretical profile in the rotation process of the cylindrical cam 16, so that the inner radius $R_{inner}$ and the outer radius $R_{outer}$ of the cylindrical cam 16 are determined, then the wall height $R_{outer}$ tan theta on the outer radius and the wall height $R_{inner}$ tan theta on the inner radius are obtained, the fish body fluctuates for one cycle, the cylindrical cam 16 rotates for one circle, and the position of each point of the contour of the space cam is calculated according to the included angle theta at each moment to obtain the space cam structure capable of fitting the included angle between the line segments of the fish body fluctuation curve.

In the embodiment, the fish body fluctuation curve at a certain moment t is selected, the contact points of the cylindrical cams 16 and the second bearings 20 when the fish body fluctuation curve is structurally simulated at the moment are used as initial positions of the cylindrical cams 16, and the contour of the inner radius of the cylindrical cam 16 is unfolded into a plane pattern along the height where the initial positions is located; the plane pattern is provided with three linear edges and one curved edge, two of the linear edges are the sides where the initial positions of the cylindrical cams 16 are located, the other linear edge is the side where the cylindrical cam 16 is not in contact with the end of the second bearing 20, and the curved edge is the side where the cylindrical cam 16 is in contact with the end of the second bearing 20. Assuming that the intersection point of the side where the initial position of the cylindrical cam 16 is located and the side where the end of the cylindrical cam 16 is not in contact with the second bearing 20 is the O point, the side where the end of the cylindrical cam 16 is not in contact with the second bearing 20 is the x-axis, and the side where the initial position of the cylindrical cam 16 is located is the y-axis, and as shown in FIG. 5, each cylindrical cam 16 is designed as follows:

The inner radius of the cylindrical cam 16 on the second side of the rack 13 of the fish head module 1 is 43 mm, the outer radius of the cylindrical cam 16 on the second side of the rack 13 of the fish head module 1 is 48 mm, and the curve where the contour shape of the end of the inner radius, making contact with the second bearing 20 on the first fish body module 2, is located is y=8.184*sin (0.02327*x+2.601)+6.075*sin (0.00007636*x−0.7375)+28.

The inner radius of the cylindrical cam 16 on the second side of the rack 13 of the first fish body module 2 is 39 mm, the outer radius of the cylindrical cam 16 on the second side of the rack 13 of the first fish body module 2 is 44 mm, and the curve where the contour shape of the end of the inner radius, making contact with the second bearing 20 on the second fish body module 3, is located is y=5.578*sin (0.008735*x+3.38)+7.731*sin (0.02908*x+0.1015)+1.624*sin (0.03545*x+2.148)+0.143*sin (0.07395*x−1.271)+28;

The inner radius of the cylindrical cam 16 on the second side of the rack 13 of the second fish body module 3 is 35 mm, the outer radius of the cylindrical cam 16 on the second side of the rack 13 of the second fish body module 3 is 40 mm, and the curve where the contour shape of the end of the inner radius, making contact with the second bearing 20 on the third fish body module 4, is located is y=18.32*sin (0.01091*x+4.562)+18.07*sin (0.01674*x+0.973)+2.475*sin (0.0353*x−0.7 561)+0.1945*sin (0.08463*x−3.788)+28;

The inner radius of the cylindrical cam 16 on the second side of the rack 13 of the third fish body module 4 is 29 mm, the outer radius of the cylindrical cam 16 on the second side of the rack 13 of the third fish body module 4 is 34 mm, and the curve where the contour shape of the end of the inner radius, making contact with the second bearing 20 on the fourth fish body module 5, is located is y=4.505*sin (0.0002291*x+5.151)+6.213*sin (0.03454*x−0.867)+0.1899*sin (0.1006*x−5.827)+28;

The inner radius of the cylindrical cam 16 on the second side of the rack 13 of the fourth fish body module 5 is 22 mm, the outer radius of the cylindrical cam 16 on the second side of the rack 13 of the fourth fish body module 5 is 27 mm, and the curve where the contour shape of the end of the inner radius, making contact with the second bearing 20 on the fifth fish body module 6, is located is y=4.008*sin (0.0001436*x−1.496)+5.047*sin (0.04599*x−1.585)−0.1914*sin (0.1357*x−5.196)+28; and The inner radius of the cylindrical cam 16 on the second side of the rack 13 of the fifth fish body module 6 is 15.3 mm, the outer radius of the cylindrical cam 16 on the second side of the rack 13 of the fifth fish body module 6 is 20.3 mm, and the curve where the contour shape of the end of the inner radius, making contact with the second bearing 20 on the fish tail module 7, is located is y=10.21*sin (0.0322*x−3.39)+9.812*sin (0.05104*x−1.337)+0.1537*sin (0.1384*x−0.4167)+0.2116*sin (0.2088*x+1.437)+28.

The fish head module 1, the first fish body module 1 to the fifth fish body module 6 and the fish tail module 7 are connected in sequence, and the robotic fish can achieve the swimming postures of real fish.

The embodiments of the present disclosure are described above with reference to the attached figures, but the present disclosure is not limited to the foregoing embodiments. The foregoing embodiments are only illustrative rather than restrictive. Inspired by the present disclosure, those skilled in the art can still derive many variations without departing from the essence of the present disclosure and the protection scope of the claims. All these variations shall fall within the protection of the present disclosure.

What is claimed is:

1. A bionic fish single-degree-of-freedom modular structure based on a cam mechanism, comprising a plurality of modules which are sequentially connected, the foremost one of the modules being a fish head module, and the last one of the modules being a fish tail module; each module in the modules comprising a rack, a rotating shaft being arranged in the center of the rack in a penetrating mode so that the first end of the rotating shaft is located on the first side of the rack and the second end, opposite to the first end, of the rotating shaft is located on the second side, opposite to the first side, of the rack, and the second end of the rotating shaft of the previous module being connected to the first end of the rotating shaft of the next module through a universal coupling, wherein the fish head module is internally provided with a control motor, and the control motor is used for driving a rotating shaft of the fish head module to rotate;

and the bionic fish single-degree-of-freedom modular structure further comprises swing connecting pieces arranged between the adjacent modules of the modules, the swing connecting piece comprising:

cylindrical cams, the cylindrical cams being arranged on the second side of the rack of the previous module, being arranged on the rotating shaft of the module and being capable of rotating along with the rotation of the rotating shaft;

pin shafts, the pin shafts being fixed on the second side of the rack of the previous module;

first bearings, the front bearing being arranged on the first side of the rack of the next module, the first side of the rack of the next module being connected with the pin shafts on the second side of the rack of the previous module through the first bearings, and the first bearings being used for enabling the rack of the next module to swing around the axes of the hinge pins of the rack of the previous module; and second bearings, the second bearings being arranged on the first side of the rack of the next module, inner rings of the second bearings being fixed on bearing supports and being connected to the rack of the next module through the bearing supports, outer rings of the second bearings being in contact with the cylindrical cam of the previous module, so that the cylindrical cam of the previous module rotates to push the second bearings of the next module to reciprocate, and then the rack of the next module swings around the axes of the pin shafts of the rack of the previous module.

2. The bionic fish single-degree-of-freedom modular structure based on a cam mechanism according to claim 1, wherein the cylindrical cam is of a cylindrical structure, the side walls of the cylindrical structures are unequal in heights, the contact points of the cylindrical cams and the second bearings are used as initial positions of the cylindrical cams when the structure simulates a fish body fluctuation curve at the moment t, and when the contour of the inner radius of the cylindrical structure is unfolded into a plane along the high position where the initial positions are located, and the outline of the end part, in contact with the second bearings, of the cylindrical structure is a curve.

3. The bionic fish single-degree-of-freedom modular structure based on a cam mechanism according to claim 2, wherein the curve is obtained by calculating the contour height of the cylindrical cam at each moment in one period through an actual sailfish fluctuation curve and approximating through a sine curve.

4. The bionic fish single-degree-of-freedom modular structure based on a cam mechanism according to claim 1, wherein in the modules, the modules except the fish head module and the fish tail module are fish body modules, and the number of the fish body modules is larger than or equal to 0.

5. The bionic fish single-degree-of-freedom modular structure based on a cam mechanism according to claim 1, wherein the fish head module is further internally provided with a battery pack for providing energy.

6. The bionic fish single-degree-of-freedom modular structure based on a cam mechanism according to claim 1, wherein the fish head module is further internally provided with a control panel, the control panel is connected with the control motor, and the control panel receives signals of an upper computer and controls the activity and the rotating speed of the control motor.

7. The bionic fish single-degree-of-freedom modular structure based on a cam mechanism according to claim 1, wherein the number of the pin shafts is two, the two pin shafts are arranged along the circumferential direction of the rack where the pin shafts are located at an interval of 180°, and the first bearings correspond to the pin shafts in a one-to-one mode; and the number of the second bearings is two, the two second bearings are arranged along the circumferential directions of the cylindrical cams matched with the second bearings at an interval of 180°, and the planes where the two bearing supports for fixing the two second bearings are located are perpendicular to the axes of the pin shafts.

* * * * *